US012723847B2

(12) United States Patent
Williamson et al.

(10) Patent No.: US 12,723,847 B2
(45) Date of Patent: Sep. 1, 2026

(54) ANTI-SKIP BALLISTIC PROTECTOR

(71) Applicant: Point Blank Enterprises, Inc., Pompano Beach, FL (US)

(72) Inventors: Brandon Williamson, North East, MD (US); Mathew Crespo, Miami, FL (US); Luz Nunez Mainardi, Tamarac, FL (US)

(73) Assignee: Point Blank Enterprises, Inc., Pompano Beach, FL (US)

( * ) Notice: Subject to any disclaimer, the term of this patent is extended or adjusted under 35 U.S.C. 154(b) by 0 days.

(21) Appl. No.: 18/950,551

(22) Filed: Nov. 18, 2024

(65) Prior Publication Data

US 2026/0139928 A1 May 21, 2026

(51) Int. Cl.
*F41H 5/02* (2006.01)
*F41H 1/02* (2006.01)
*A41D 13/015* (2006.01)

(52) U.S. Cl.
CPC ..... *F41H 1/02* (2013.01)

(58) Field of Classification Search
CPC ..... F41H 1/02; F41H 5/0485; F41H 5/0478; F41H 5/04; F41H 5/0471; F41H 5/0492; F41H 5/013; F41H 5/08; F41H 1/00; F41H 3/02; F41H 5/0442; F41H 5/023; F41H 7/04; F41H 5/06
See application file for complete search history.

(56) References Cited

U.S. PATENT DOCUMENTS 4,079,464 A * 3/1978 Roggin ..... F41H 1/02 2/2.5
4,266,297 A * 5/1981 Atkins ..... F41H 1/02 2/2.5
4,485,491 A * 12/1984 Rasmussen ..... F41H 1/02 2/2.5
4,497,069 A * 2/1985 Braunhut ..... F41H 1/02 2/2.5
4,507,802 A * 4/1985 Small ..... F41H 1/02 2/2.5
7,628,104 B2 * 12/2009 Warren ..... F41H 5/0428 89/36.02
7,665,149 B2 * 2/2010 Carbajal ..... F41H 5/0485 2/2.5
7,921,759 B2 * 4/2011 Warren ..... F41H 5/0492 89/36.02
8,365,312 B2 * 2/2013 Herring ..... A41D 13/0007 2/2.5
9,456,679 B2 * 10/2016 Willows ..... A45F 5/00
10,648,780 B2 * 5/2020 Fornusek ..... E04H 17/18
11,499,803 B2 * 11/2022 Amidon ..... E04G 23/0211
(Continued)

*Primary Examiner* — Robert H Muromoto, Jr.
(74) *Attorney, Agent, or Firm* — Geoffrey Lottenberg; Berger Singerman LLP

(57) ABSTRACT

An anti-skip ballistic protector is provided, including a ballistic panel having a front face, a rear face, and an upper end. A portion of the upper end of the ballistic panel is folded and secured to the front face of the ballistic panel to provide a raised edge configured to stop a flying projectile. The upper end is heat-sealed and stitched to the front face of the ballistic panel, and in some examples, the ballistic panel includes a ply of ballistic material. The ballistic panel is either removably attached to the ballistic garment or included with the ballistic garment.

20 Claims, 8 Drawing Sheets

(56) References Cited

U.S. PATENT DOCUMENTS

| | | | | |
|---|---|---|---|---|
| 2010/0005556 | A1* | 1/2010 | Pittman | F41H 1/02 156/286 |
| 2012/0090452 | A1* | 4/2012 | Sudhakar | F41H 5/0457 70/237 |
| 2012/0174876 | A1* | 7/2012 | Johnson | F41H 1/02 119/850 |
| 2012/0304354 | A1* | 12/2012 | Fearon | A41D 13/0543 2/2.5 |
| 2014/0076138 | A1* | 3/2014 | Owen | F41H 5/0428 89/36.02 |
| 2017/0254625 | A1* | 9/2017 | Spransy | B32B 5/16 |
| 2019/0174903 | A1* | 6/2019 | Holder | A45F 3/06 |
| 2020/0326159 | A1* | 10/2020 | Saad | A42B 1/08 |
| 2022/0136805 | A1* | 5/2022 | McMurray | B32B 27/365 89/36.02 |

* cited by examiner

ANTI-SKIP BALLISTIC PROTECTOR

FIELD OF THE INVENTION

The present invention relates generally to wearable ballistic protection and, more particularly, to an anti-skip ballistic protector that is attachable to a ballistic garment.

BACKGROUND OF THE INVENTION

Soft body armor is a type of ballistic garment made out of a high-performance fabric, such as Kevlar, Dyneema, or Twaron, that is woven or fibrous and is lightweight and flexible. The ballistic garment is one form of protective gear designed to absorb and dissipate the energy of a high-velocity projectile, such as bullets or shrapnel. Ballistic garments are generally unisex garments that are worn by both men and women alike. As more women join active-duty services, such as our armed forces, federal agencies, and local law enforcement, which require the donning of a ballistic garment, the anatomical differences between men and women have heightened certain susceptibilities women face.

For instance, it is now known that projectiles can skip off the top center of a ballistic garment and impact the wearer if the projectile impacts the ballistic garment at a certain angle of attack proximate to the top center of the ballistic garment where a woman's breast or a man with a large chest is positioned. The voids created by the person's contours allow the ballistic garment to displace instead of immediately interacting or otherwise stopping the projectile when the projectile contacts the ballistic garment. Once the ballistic garment's displacement yields, the resistance applied to the projectile by the ballistic garment causes the projectile to skip off at an awkward angle. In most cases, the projectile skips upwardly and contacts the person's exposed throat region, where the person's two sternoclavicular joints meet the jugular notch, resulting in severe injuries or death of the person.

Accordingly, there is an established need for an anti-skip ballistic protector to address at least the foregoing problems.

SUMMARY OF THE INVENTION

The present invention is directed to an anti-skip ballistic protector. In a first embodiment, the anti-skip ballistic protector, comprises a ballistic panel including a front face, a rear face, and an upper end. A portion of the upper end of the ballistic panel is folded and secured to the front face of the ballistic panel to provide a raised edge configured to stop a flying projectile, and the ballistic panel is removably attachable to a ballistic garment.

In another aspect, the portion of the upper end folded to the front face of the ballistic panel can be heat-sealed or stitched to the front face.

In another aspect, the ballistic panel may comprise a ply of ballistic material.

In another aspect, a fastener may be disposed on the rear face of the ballistic panel to removably secure the ballistic panel to the ballistic garment. The fastener may include a hook and loop fastener or the like where a hook fastener is disposed on the ballistic panel and a loop fastener is disposed on the ballistic garment. The ballistic panel may be removably attached to the ballistic garment proximate to the ballistic garment's neckline, with the portion of the upper end facing away from the exterior surface of the ballistic panel and the raised edge facing downwardly, opposite the neckline of the ballistic garment.

In a second embodiment, a ballistic garment with an anti-skip ballistic protector is provided. The garment comprises a ballistic panel attached to the front face of the ballistic panel, with a portion of the upper end of the ballistic panel folded and secured to the front face of the ballistic panel via stitching and/or a heat seal to provide a raised edge configured to stop a flying projectile.

In yet another aspect, a method for donning a ballistic garment having an anti-skip ballistic protector is shown. The method includes providing a ballistic garment having a neckline; providing a ballistic panel that includes a front face, a rear face, and an upper end, wherein a portion of the upper end of the ballistic panel is folded and secured to the front face of the ballistic panel to provide a raised edge configured to stop a flying projectile; attaching the ballistic panel to a ballistic garment; and donning the ballistic garment.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
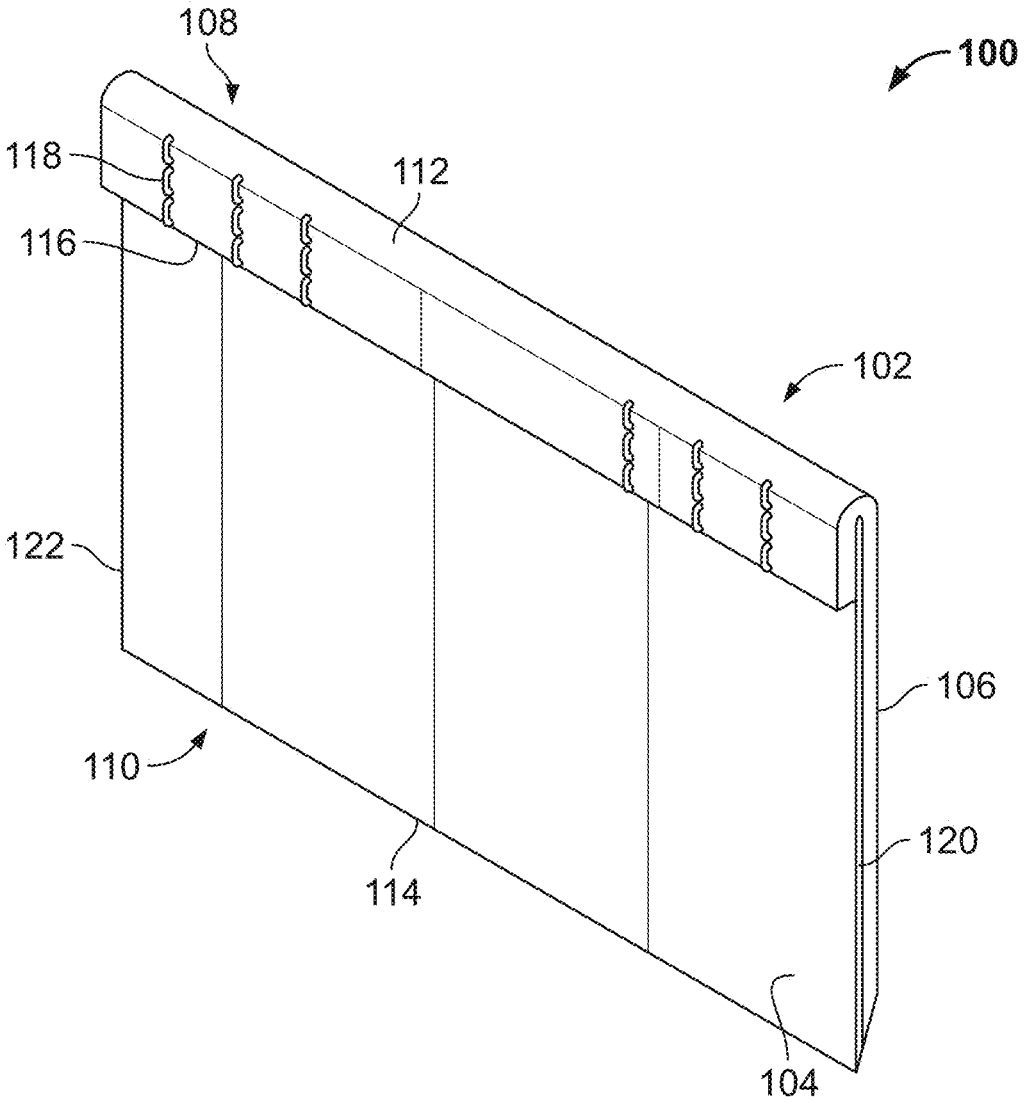
FIG. 1 presents a front perspective view of an exemplary embodiment of an anti-skip ballistic protector in accordance with the instant invention.
Figure 2:
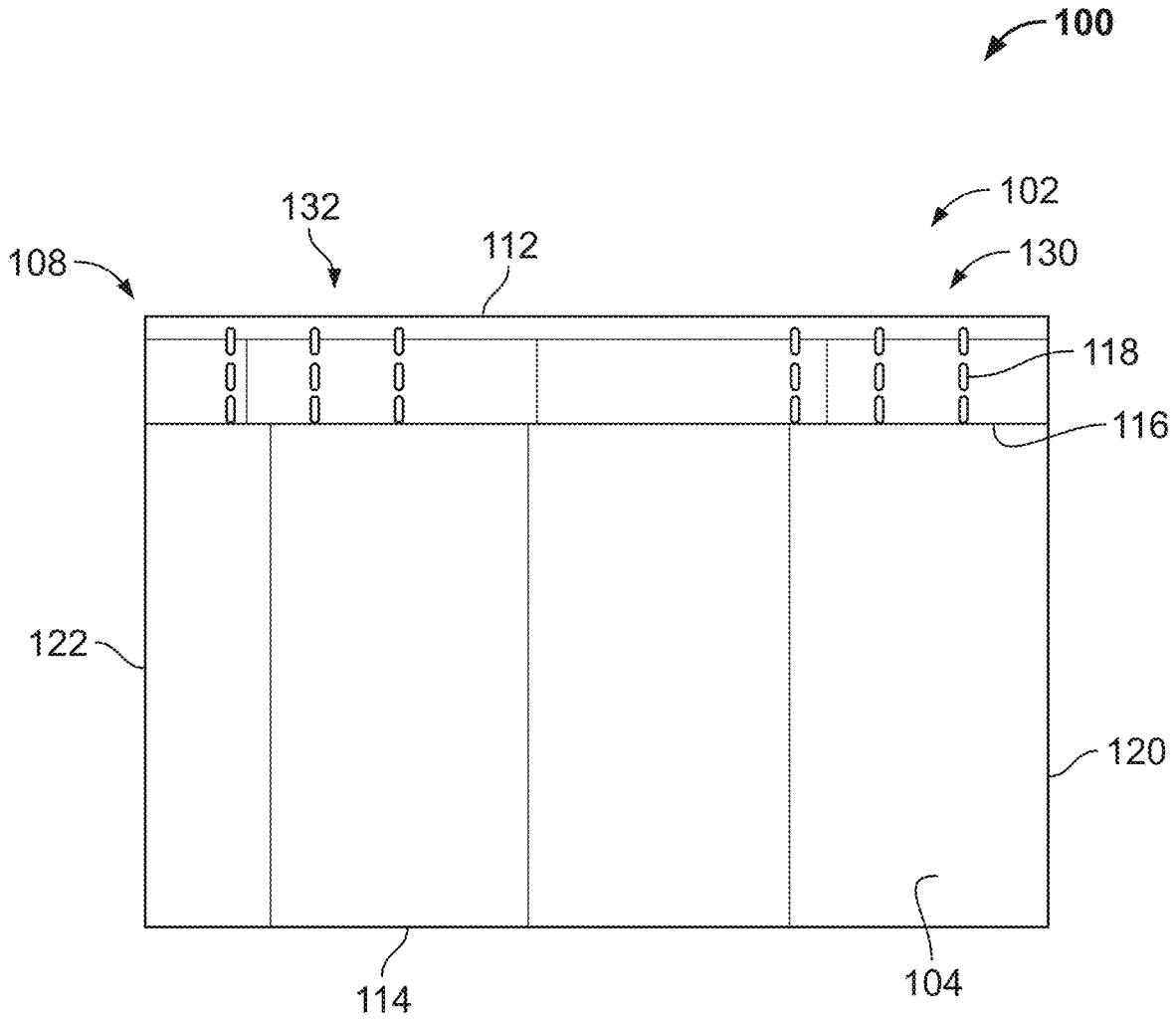
FIG. 2 presents a front plan view of the anti-skip ballistic protector.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring initially to FIGS. 1 through 4, an anti-skip ballistic protector 100 (the "protector") is generally shown. The protector generally includes a ballistic panel 102 having a front face 104 and a rear face 106 that extends longitudinally between opposing side ends 120, 122, and extends vertically between a lower edge 114 and a top edge 112. The protector 102 further includes an upper end portion 108 that is folded and secured to the front face 104 of the ballistic panel 102 to provide a raised edge 116. In one exemplary embodiment, the upper end portion 108 folded to the front face 104 of the ballistic panel is heat sealed to the ballistic panel's front face 104. Alternatively, or in addition, the upper end portion 108 folded to the front face 104 of the ballistic panel is stitched to the ballistic panel's front face 104 with stitching 118 made out of nylon or alternative materials akin to nylon. As exemplarily shown in one non-limiting example, the upper end portion 108 is stitched by a total of 6 stitches spaced apart along the longitudinal length of the fold. Although the number of stitches may vary, and thus, the number disclosed should be understood to be exemplary and not limiting, 6 stitches is the minimal amount of stitches needed to sufficiently hold the fold in place and stop a projectile.

In some exemplary embodiments, the stitching is approximately ¾ of an inch long, extending perpendicular to the upper edge 112 of the ballistic panel 102, and spaced apart in equidistant intervals of ¾ inch from the first stitch proximate to a first opposing side end 120 in a grouping of three 130. Opposite the first grouping of stitches 130, the ballistic panel 102 includes a second grouping of stitches 132 that are also equidistantly spaced apart in a substantially similar manner as the first grouping 130. Put differently, the groupings of stitches substantially mirror one another and are disposed close to their respective side ends 120, 122 spaced apart and spanning inwardly along the longitudinal length of the fold. The benefits associated with this stitching configuration include but are not limited to allowing the raised edge 116 material to remain unaltered and in a static position (i.e., it does not displace) after a projectile makes contact with the protector 100. This allows the protector to provide maximum protection to the person's throat area by not weakening an area of material provided between the first and second grouping of stitches 130, 132, on the raised edge, which would otherwise be weakened if stitched together. Alternative methods of securing the folded upper end portion 108 of the ballistic panel 102 to the front face 104 include but are not limited to adhesives, heat sealing, and binding with a nylon fabric.

Figure 3:
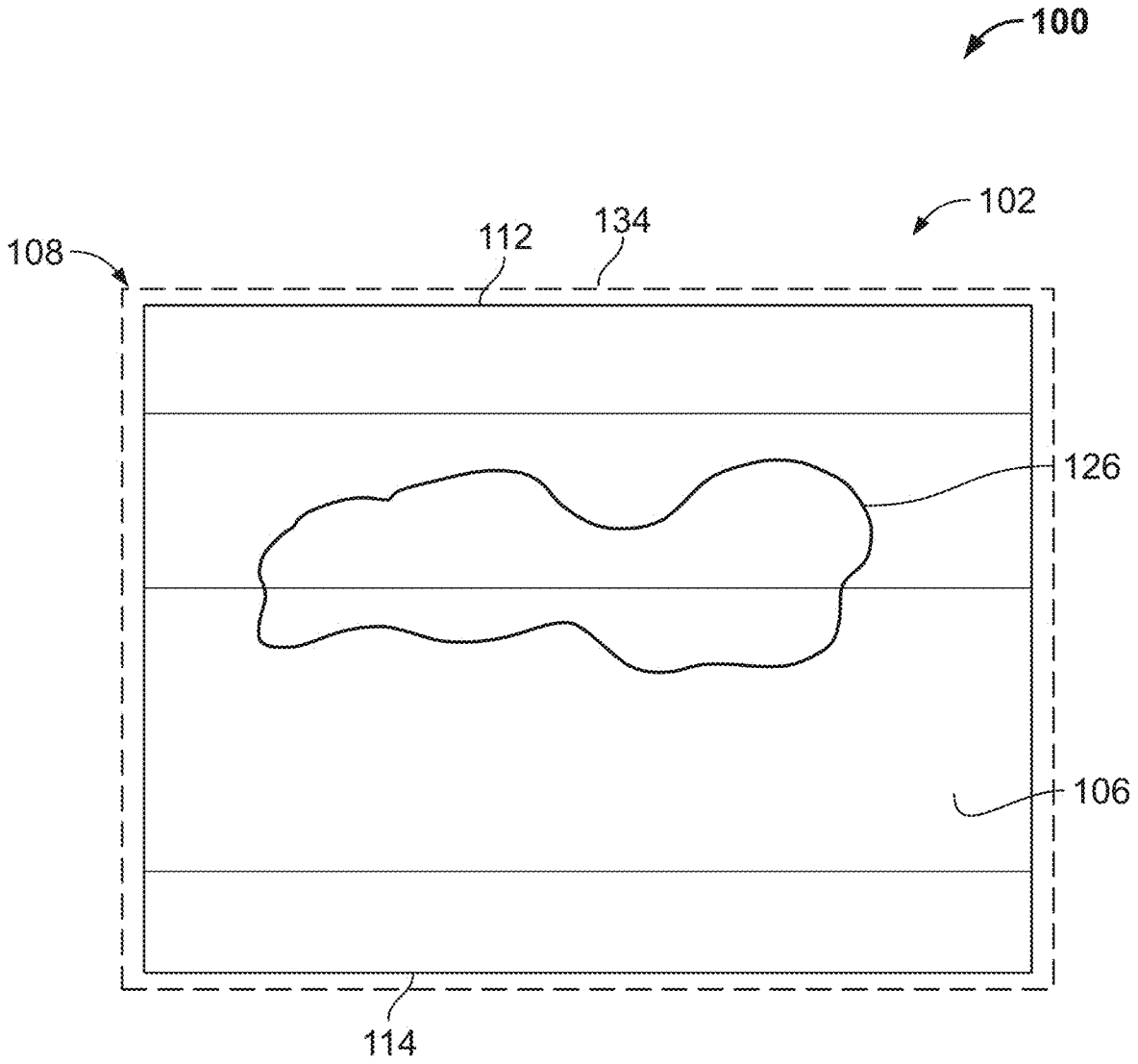
FIG. 3 presents a rear plan view of the anti-skip ballistic protector.
Figure 4:
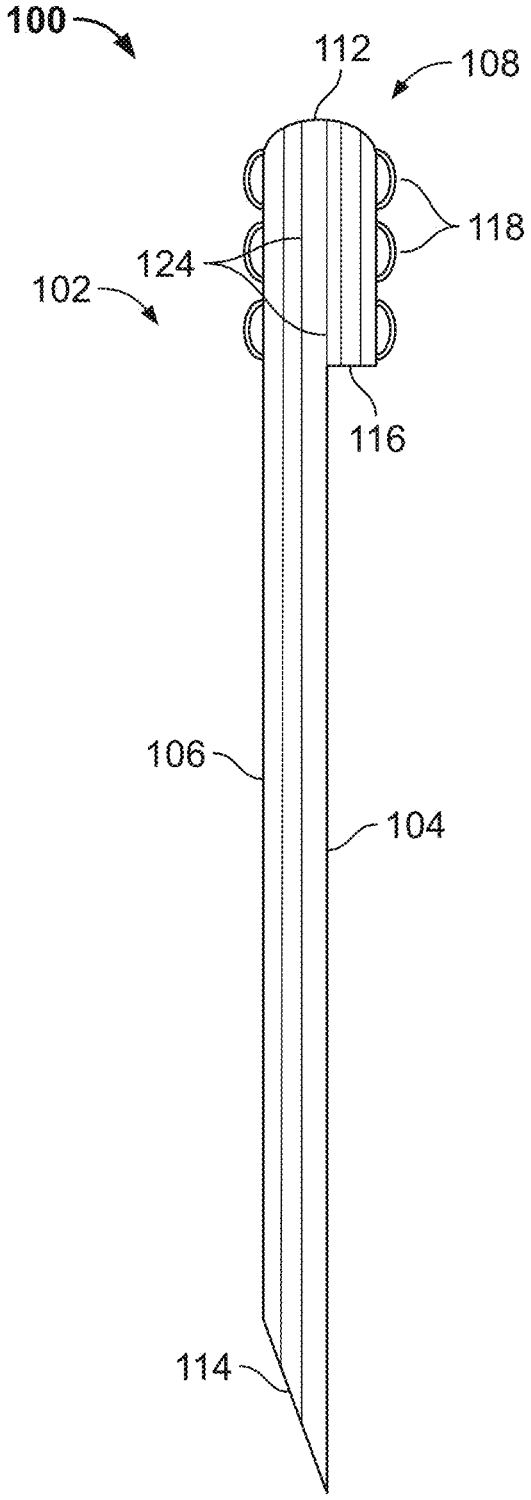
FIG. 4 presents a right plan view of the anti-skip ballistic protector.
Figure 5:
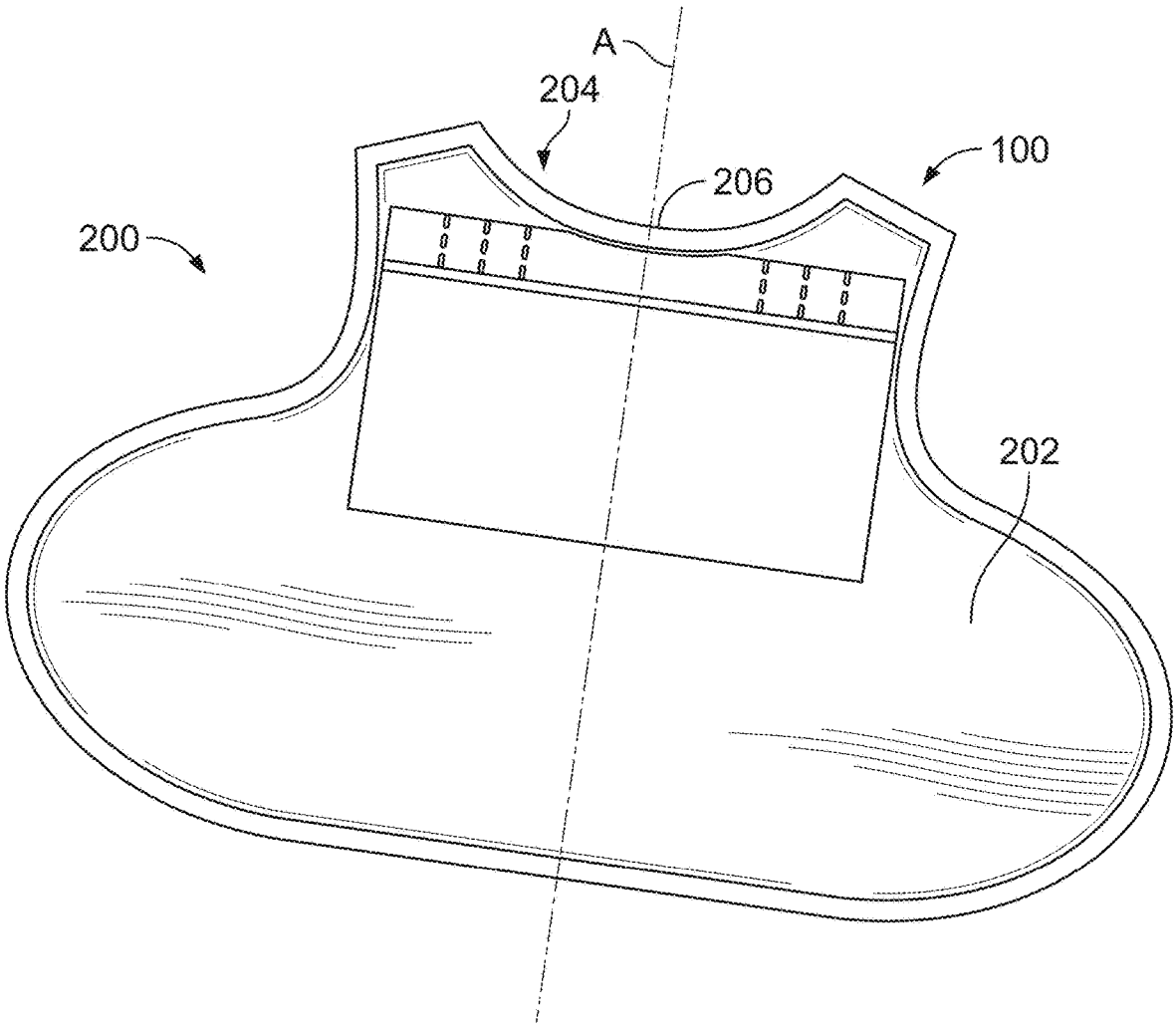
FIG. 5 presents a front perspective view of the anti-skip ballistic protector attached to a ballistic garment.
Figure 6:
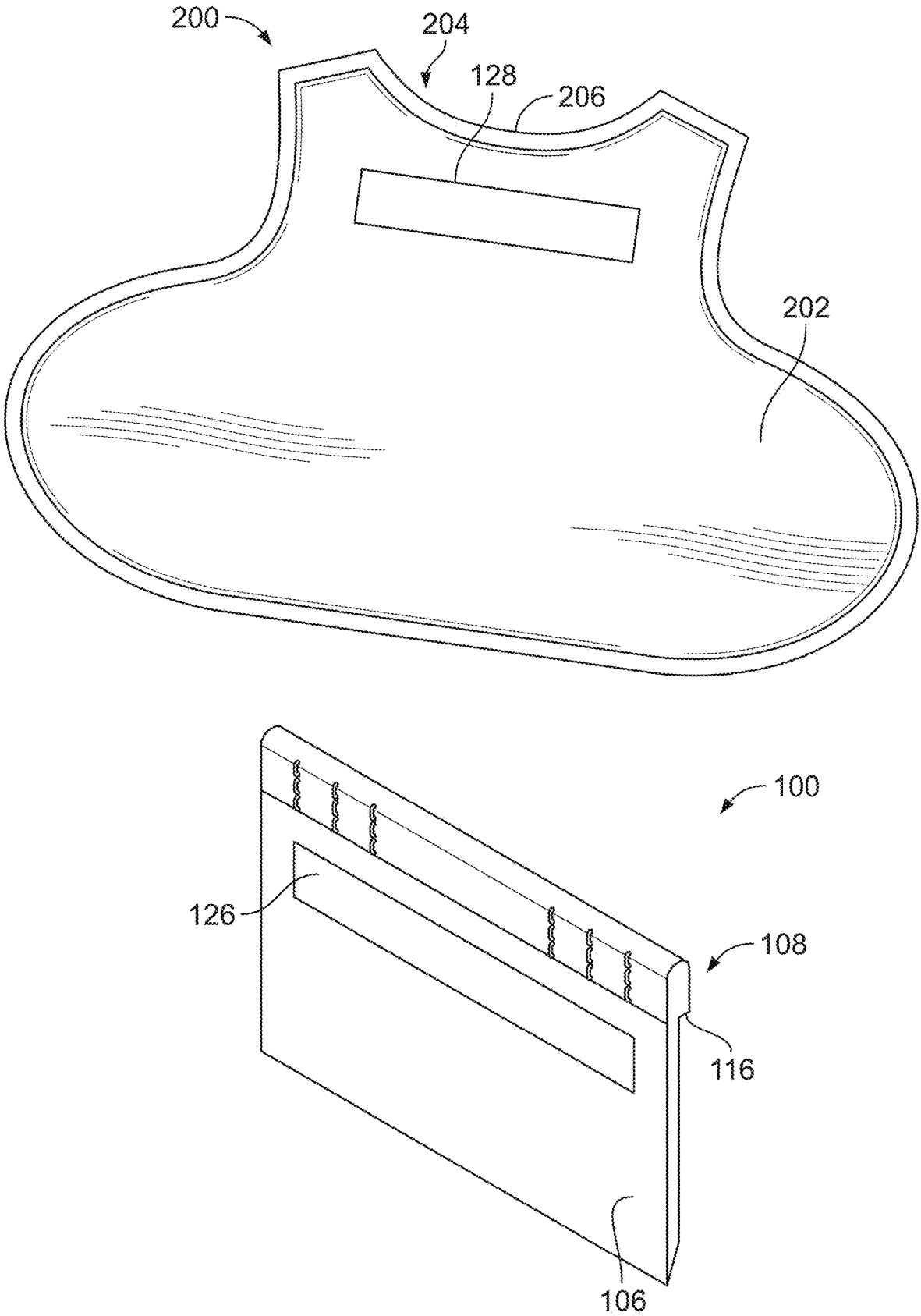
FIG. 6 presents a front perspective view of the anti-skip ballistic protector detached from the ballistic garment.

With reference to FIGS. 1, 3 through 7, a fastener 126 for securing the protector 100 to a ballistic garment 200 is included to the rear face 106 of the ballistic panel 102 in one exemplary embodiment. As illustrated in FIG. 3, the fastener 126 may be included anywhere on the rear face 106 of the ballistic panel. Alternatively, the fastener 126 is attached to a casing 134 that at least partially encases the protector 100 inside the casing 134. In one exemplary embodiment, the fastener 126 is a hook that engages with a loop 128 on the ballistic garment 200. This is exemplarily shown in FIGS. 6 and 7. As illustrated, the hook or loop fastener 126 is applied to the rear face 106 of the ballistic panel, and the opposite engaging hook or loops are applied to the front face 202 of the ballistic garment 200. Alternative fasteners such as buttons, zippers, or specialized adhesives, however, may be utilized without departing from the scope of the invention. Securing the protector 100 to the ballistic garment further includes substantially aligning a central axis A of the ballistic garment with the apex 206 of the neckline 204 of the ballistic garment 200. The protector 100 is thus disposed substantially proximate to the neckline 204 of the garment 200. In one exemplary embodiment, the protector is disposed about 1 inch from the apex 206 of the neckline 204 of the ballistic garment 200.

Figure 7:
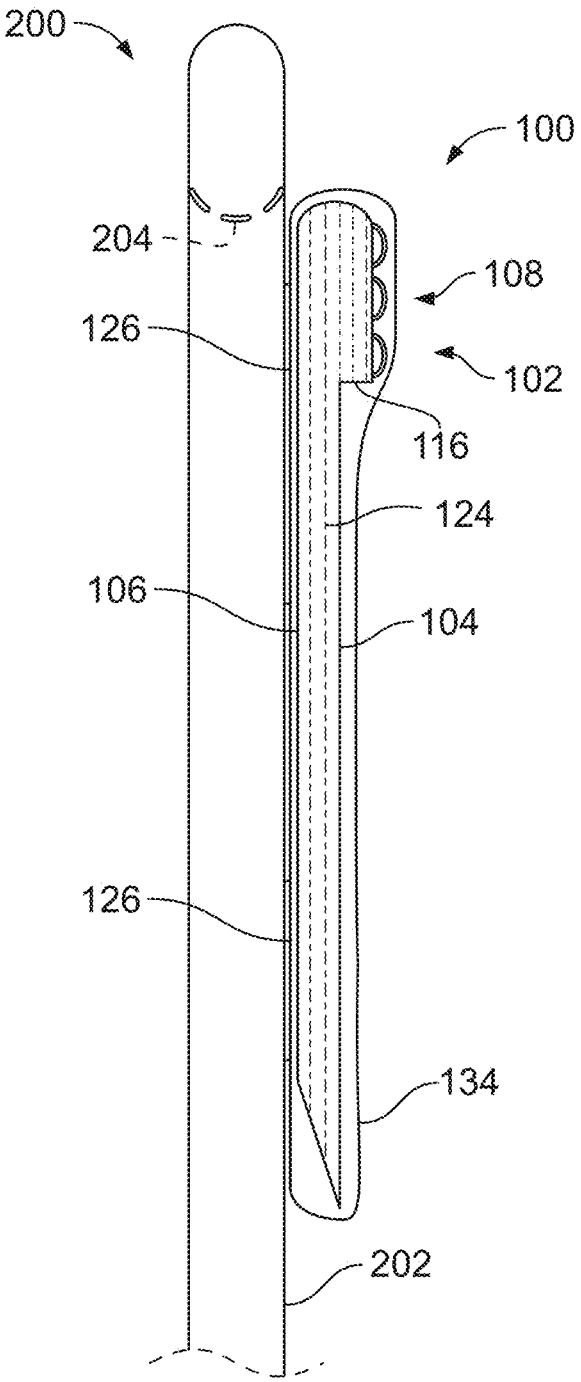
FIG. 7 presents a right plan view of the anti-skip ballistic protector attached to the ballistic garment.

As illustrated in FIG. 7, in some embodiments, the ballistic panel 102 is at least partially encased with a casing 134, which may comprise resilient nylon or other materials, is attached to the front surface 202 of the ballistic garment 200 and proximate to the neckline 204 of the ballistic garment 200, with the portion of the upper end 108 facing away from the front surface 202 of the ballistic garment 200 and the raised edge 116 facing downwardly, opposite the neckline 204 of the ballistic garment 200. The protector 100 can be removably attached to the ballistic garment 200 with fasteners 126, as discussed above. Alternative embodiments include the protector 100 irremovably secured to the ballistic garment 200.

In one exemplary form, the protector 100 includes a ballistic panel 102 comprising a ply of ballistic material 124, such as Dyneema or the like, heat sealed together. In some exemplary embodiments, the number of plies is two or more and up to 20. In this configuration, the plies are aligned together to form a unibody ballistic panel 102 that includes an upper portion 108 that is folded and secured to the front face 104 of the ballistic panel 102 to provide a raised edge 116 that is capable of stopping a high-velocity projectile, such as a bullet or shrapnel. The ply material can be heat sealed and/or stitched as described above.

Figure 8:
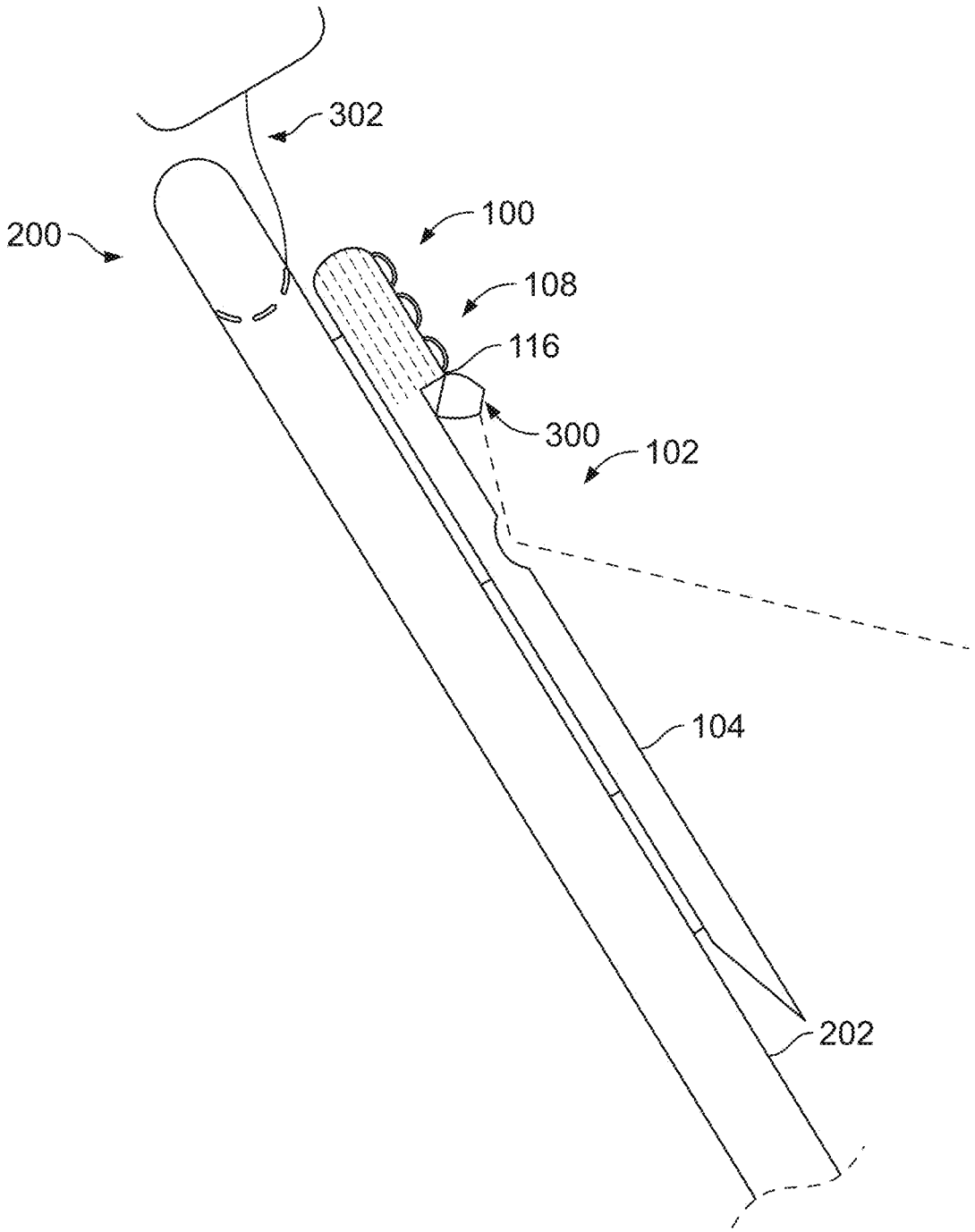
FIG. 8 presents a right plan view of the anti-skip ballistic protector attached to the ballistic garment and capturing a skipping projectile.

Turning now to FIG. 8, which illustrates how the protector 100 secured to a ballistic garment 200 is capable of catching a high-velocity projectile 300 that skipped off the ballistic panel 102 by protecting the throat region 302 of the wearer who would have otherwise suffered a potentially fatal injury from the skipping projectile is shown. In instances where the angle of attack of the projectile 300 is such that ballistic garment 200 alone would not catch the projectile and is incapable of stopping the projectile from skipping, the protector 100 is designed and otherwise configured to provide sufficient resistance to the path of the projectile to orient the projectile's trajectory toward the raised edge 116 provided by the ballistic panel 102. When the projectile 300 makes contact with the raised edge 116 of the ballistic panel 102 of the protector, the projectile 300 is captured, and its upward, skipping trajectory toward the wearer's neck and throat region 302 ceases. Although the protector 100 is designed to prevent skipping projectiles from reaching a wearer's throat region are traveling at different angles of attack, the instant invention is notably geared at catching skipping projectiles that are traveling at substantially a 45-degree angle toward the neckline of the person. In some exemplary embodiments, the protector's size includes 6 in.×8 in. and 5 in.×8 in.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. An anti-skip ballistic protector, comprising:

a ballistic panel including a front face, a rear face, and an upper end;

wherein a portion of the upper end of the ballistic panel is folded back onto the front face of the ballistic panel and secured to the front face of the ballistic panel to provide a raised edge elevating from the front face of the ballistic panel, the raised edge configured to stop a flying projectile; and wherein the ballistic panel is removably attachable to a ballistic garment.

2. The anti-skip ballistic protector of claim 1, wherein the portion of the upper end folded to the front face of the ballistic panel is heat sealed to the front face.

3. The anti-skip ballistic protector of claim 1, wherein the portion of the upper end folded to the front face of the ballistic panel is stitched to the front face.

4. The anti-skip ballistic protector of claim 1, wherein the ballistic panel includes a ply of ballistic material.

5. The anti-skip ballistic protector of claim 1, wherein a fastener is disposed on the rear face of the ballistic panel to removably secure the ballistic panel to the ballistic garment.

6. The anti-skip ballistic protector of claim 1, wherein the ballistic panel is removably attached to an exterior surface of the ballistic garment and proximate to a neckline of the ballistic garment, with the portion of the upper end facing away from the exterior surface of the ballistic garment and the raised edge facing downwardly, opposite the neckline of the ballistic garment.

7. A method for donning a ballistic garment having an anti-skip ballistic protector, comprising:

providing a ballistic garment having a neckline;

providing a ballistic panel that includes a front face, a rear face, and an upper end, wherein a portion of the upper end of the ballistic panel is folded back onto the front face of the ballistic panel and secured to the front face of the ballistic panel to provide a raised edge elevating from the front face of the ballistic panel, the raised edge configured to stop a flying projectile;

attaching the ballistic panel to a ballistic garment; and donning the ballistic garment.

8. The method of claim 7, wherein the portion of the upper end folded to the front face of the ballistic panel is heat sealed to the front face.

9. The method of claim 7, wherein the portion of the upper end folded to the front face of the ballistic panel is stitched to the front face.

10. The method of claim 7, wherein the ballistic panel includes a ply of ballistic material.

11. The method of claim 7, wherein a fastener is disposed on the rear face of the ballistic panel to removably secure the ballistic panel to the ballistic garment.

12. The method of claim 7, wherein attaching the ballistic panel to the ballistic garment includes substantially aligning a central axis of the ballistic garment with an apex of the neckline of the ballistic garment.

13. The method of claim 7, wherein the ballistic panel is removably attached to an exterior surface of the ballistic garment and proximate to the neckline of the ballistic garment with the portion of the upper end facing away from the exterior surface of the ballistic garment and the raised edge facing downwardly, opposite the neckline of the ballistic garment.

14. A ballistic garment with an anti-skip ballistic protector, comprising:

a ballistic garment including a front face; and a ballistic panel attached to the front face of the ballistic garment that includes a front face, a rear face, and an upper end, wherein a portion of the upper end of the ballistic panel is folded back onto the front face of the ballistic panel and secured to the front face of the ballistic panel to provide a raised edge elevating from the front face of the ballistic panel, the raised edge configured to stop a flying projectile.

15. The ballistic garment of claim 14, wherein the portion of the upper end folded to the front face of the ballistic panel is heat sealed to the front face.

16. The ballistic garment of claim 14, wherein the portion of the upper end folded to the front face of the ballistic panel is stitched to the front face.

17. The ballistic garment of claim 14, wherein the ballistic panel includes a ply of ballistic material.

18. The ballistic garment of claim 14, wherein a fastener is disposed on the rear face of the ballistic panel to removably secure the ballistic panel to the ballistic garment.

19. The ballistic garment of claim 14, wherein the ballistic panel is attached to the front face of the ballistic garment proximate to a neckline of the ballistic garment with the portion of the upper end facing away from the exterior surface of the ballistic garment and the raised edge facing downwardly, opposite the neckline of the ballistic garment.

20. The ballistic garment of claim 19, wherein a central axis of the ballistic garment substantially aligns with an apex of the neckline of the ballistic garment.

* * * * *